US011580932B2

(12) United States Patent
Niizuma et al.

(10) Patent No.: US 11,580,932 B2
(45) Date of Patent: Feb. 14, 2023

(54) DISPLAY DEVICE AND DISPLAY METHOD

(71) Applicant: SHARP KABUSHIKI KAISHA, Sakai (JP)

(72) Inventors: Ryosuke Niizuma, Sakai (JP); Hironori Shimoda, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/538,456

(22) Filed: Nov. 30, 2021

(65) Prior Publication Data

US 2022/0180839 A1 Jun. 9, 2022

(30) Foreign Application Priority Data

Dec. 7, 2020 (JP) ..... JP2020-202426

(51) Int. Cl.
*G09G 5/06* (2006.01)
*G09G 3/20* (2006.01)

(52) U.S. Cl.
CPC ..... *G09G 5/06* (2013.01); *G09G 3/2003* (2013.01); *G09G 2340/06* (2013.01)

(58) Field of Classification Search
CPC ..... G09G 5/06; G09G 3/2003; G09G 2340/06
See application file for complete search history.

(56) References Cited

U.S. PATENT DOCUMENTS

2015/0077640 A1 3/2015 Kanda
2015/0312542 A1* 10/2015 Suginohara ..... H04N 9/77 345/603
2019/0335082 A1* 10/2019 Chang ..... H04N 5/2355

FOREIGN PATENT DOCUMENTS

WO 2013/128687 A1 9/2013

* cited by examiner

*Primary Examiner* — Robert J Michaud
(74) *Attorney, Agent, or Firm* — ScienBiziP, P.C.

(57) ABSTRACT

A display device, includes: a first processor configured to increase or decrease values of color components representing three colors and included in a first video signal, in accordance with values corresponding to the values of the color components representing three colors; a second processor configured to convert a second video signal into a third video signal, the second video signal including the color components representing three colors and having the values increased or decreased by the first processor, and the third video signal including color components representing four colors; and a display configured to display the third video signal including the color components representing four colors.

7 Claims, 11 Drawing Sheets

FIG.3A

LOOKUP TABLE 301-0

| 0 | 0 | | | 32 | | | 64 | | | 96 | | | 128 | | | 160 | | | 192 | | | 224 | | | 255 | | |
|---|---|---|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 10 | −30 | 0 | 20 | −30 | 0 | 30 | −30 |
| 32 | 0 | 0 | 0 | 0 | 0 | 0 | 0 | 0 | 0 | 0 | 0 | 0 | 0 | 0 | 0 | 0 | 0 | 0 | 0 | 10 | −30 | 0 | 20 | −30 | 0 | 30 | −30 |
| 64 | 0 | 0 | 0 | 0 | 0 | 0 | 0 | 0 | 0 | 0 | 0 | 0 | 0 | 0 | 0 | 0 | 0 | 0 | 0 | 10 | −30 | 0 | 20 | −30 | 0 | 30 | −30 |
| 96 | 0 | 0 | 0 | 0 | 0 | 0 | 0 | 0 | 0 | 0 | 0 | 0 | 0 | 0 | 0 | 0 | 0 | 0 | 0 | 10 | −30 | 0 | 20 | −30 | 0 | 30 | −30 |
| 128 | 0 | 0 | 0 | 0 | 0 | 0 | 0 | 0 | 0 | 0 | 0 | 0 | 0 | 0 | 0 | 0 | 0 | 0 | 0 | 10 | −30 | 0 | 20 | −30 | 0 | 30 | −30 |
| 160 | 0 | 0 | 0 | 0 | 0 | 0 | 0 | 0 | 0 | 0 | 0 | 0 | 0 | 0 | 0 | 0 | 0 | 0 | 0 | 10 | −30 | 0 | 20 | −30 | 0 | 30 | −30 |
| 192 | 10 | 0 | −30 | 10 | 0 | −30 | 10 | 0 | −30 | 10 | 0 | −30 | 10 | 0 | −30 | 10 | 0 | −30 | 10 | 10 | −30 | 10 | 20 | −30 | 10 | 30 | −30 |
| 224 | 20 | 0 | −30 | 20 | 0 | −30 | 20 | 0 | −30 | 20 | 0 | −30 | 20 | 0 | −30 | 20 | 0 | −30 | 20 | 10 | −30 | 20 | 20 | −30 | 20 | 30 | −30 |
| 255 | 30 | 0 | −30 | 30 | 0 | −30 | 30 | 0 | −30 | 30 | 0 | −30 | 30 | 0 | −30 | 30 | 0 | −30 | 30 | 10 | −30 | 30 | 20 | −30 | 30 | 30 | −30 |

301-32

| 32 | 0 | | | 32 | | | 64 | | | 96 | | | 128 | | | 160 | | | 192 | | | 224 | | | 255 | | |
|---|---|---|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 10 | −20 | 0 | 20 | −20 | 0 | 30 | −20 |
| 32 | 0 | 0 | 0 | 0 | 0 | 0 | 0 | 0 | 0 | 0 | 0 | 0 | 0 | 0 | 0 | 0 | 0 | 0 | 0 | 10 | −20 | 0 | 20 | −20 | 0 | 30 | −20 |
| 64 | 0 | 0 | 0 | 0 | 0 | 0 | 0 | 0 | 0 | 0 | 0 | 0 | 0 | 0 | 0 | 0 | 0 | 0 | 0 | 10 | −20 | 0 | 20 | −20 | 0 | 30 | −20 |
| 96 | 0 | 0 | 0 | 0 | 0 | 0 | 0 | 0 | 0 | 0 | 0 | 0 | 0 | 0 | 0 | 0 | 0 | 0 | 0 | 10 | −20 | 0 | 20 | −20 | 0 | 30 | −20 |
| 128 | 0 | 0 | 0 | 0 | 0 | 0 | 0 | 0 | 0 | 0 | 0 | 0 | 0 | 0 | 0 | 0 | 0 | 0 | 0 | 10 | −20 | 0 | 20 | −20 | 0 | 30 | −20 |
| 160 | 0 | 0 | 0 | 0 | 0 | 0 | 0 | 0 | 0 | 0 | 0 | 0 | 0 | 0 | 0 | 0 | 0 | 0 | 0 | 10 | −20 | 0 | 20 | −20 | 0 | 30 | −20 |
| 192 | 10 | 0 | −20 | 10 | 0 | −20 | 10 | 0 | −20 | 10 | 0 | −20 | 10 | 0 | −20 | 10 | 0 | −20 | 10 | 10 | −20 | 10 | 20 | −20 | 10 | 30 | −20 |
| 224 | 20 | 0 | −20 | 20 | 0 | −20 | 20 | 0 | −20 | 20 | 0 | −20 | 20 | 0 | −20 | 20 | 0 | −20 | 20 | 10 | −20 | 20 | 20 | −20 | 20 | 30 | −20 |
| 255 | 30 | 0 | −20 | 30 | 0 | −20 | 30 | 0 | −20 | 30 | 0 | −20 | 30 | 0 | −20 | 30 | 0 | −20 | 30 | 10 | −20 | 30 | 20 | −20 | 30 | 30 | −20 |

LOOKUP TABLE 301-64

| 64 | 0 | | | 32 | | | 64 | | | 96 | | | 128 | | | 160 | | | 192 | | | 224 | | | 255 | | |
|---|---|---|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | −10 | 10 | 0 | −15 | 20 | −5 | −20 | 30 | −10 |
| 32 | 0 | 0 | 0 | 0 | 0 | 0 | 0 | 0 | 0 | 0 | 0 | 0 | 0 | 0 | 0 | 0 | 0 | 0 | −5 | 10 | 0 | −10 | 20 | −5 | −15 | 30 | −10 |
| 64 | 0 | 0 | 0 | 0 | 0 | 0 | 0 | 0 | 0 | 0 | 0 | 0 | 0 | 0 | 0 | 0 | 0 | 0 | 0 | 10 | 0 | −5 | 20 | −5 | −10 | 30 | −10 |
| 96 | 0 | 0 | 0 | 0 | 0 | 0 | 0 | 0 | 0 | 0 | 0 | 0 | 0 | 0 | 0 | 0 | 0 | 0 | 0 | 10 | −10 | 0 | 20 | −15 | 0 | 30 | −20 |
| 128 | 0 | 0 | 0 | 0 | 0 | 0 | 0 | 0 | 0 | 0 | 0 | 0 | 0 | 0 | 0 | 0 | 0 | 0 | 0 | 10 | −15 | 0 | 20 | −20 | 0 | 30 | −25 |
| 160 | 0 | 0 | 0 | 0 | 0 | 0 | 0 | 0 | 0 | 0 | 0 | 0 | 0 | 0 | 0 | 0 | 0 | 0 | 0 | 10 | −20 | 0 | 20 | −25 | 0 | 30 | −30 |
| 192 | 10 | −10 | 0 | 10 | −5 | 0 | 10 | 0 | 0 | 10 | 0 | −10 | 10 | 0 | −15 | 10 | 0 | −20 | 10 | 10 | −25 | 10 | 20 | −30 | 10 | 30 | −35 |
| 224 | 20 | −15 | −5 | 20 | −10 | −5 | 20 | −5 | −5 | 20 | 0 | −15 | 20 | 0 | −20 | 20 | 0 | −25 | 20 | 10 | −30 | 20 | 20 | −35 | 20 | 30 | −40 |
| 255 | 30 | −20 | −10 | 30 | −15 | −10 | 30 | −10 | −10 | 30 | 0 | −20 | 30 | 0 | −25 | 30 | 0 | −30 | 30 | 10 | −35 | 30 | 20 | −40 | 30 | 30 | −45 |

301-255

| 255 | 0 | | | 32 | | | 64 | | | 96 | | | 128 | | | 160 | | | 192 | | | 224 | | | 255 | | |
|---|---|---|---|---|---|---|---|---|---|---|---|---|---|---|---|---|---|---|---|---|---|---|---|---|---|---|---|
| 0 | −30 | −30 | 30 | −30 | −20 | 30 | −30 | −10 | 30 | −30 | 0 | 30 | −30 | 0 | 30 | −30 | 0 | 30 | −30 | 10 | 30 | −30 | 20 | 30 | −30 | 30 | 30 |
| 32 | −20 | −30 | 30 | −20 | −20 | 30 | −20 | −10 | 30 | −20 | 0 | 30 | −20 | 0 | 30 | −20 | 0 | 30 | −20 | 10 | 30 | −20 | 20 | 30 | −20 | 30 | 30 |
| 64 | −10 | −30 | 30 | −10 | −20 | 30 | −10 | −10 | 30 | −10 | 0 | 30 | −10 | 0 | 30 | −10 | 0 | 30 | −10 | 10 | 30 | −10 | 20 | 30 | −10 | 30 | 30 |
| 96 | 0 | −30 | 30 | 0 | −20 | 30 | 0 | −10 | 30 | 0 | 0 | 30 | 0 | 0 | 30 | 0 | 0 | 30 | 0 | 10 | 30 | 0 | 20 | 30 | 0 | 30 | 30 |
| 128 | 0 | −30 | 30 | 0 | −20 | 30 | 0 | −10 | 30 | 0 | 0 | 30 | 0 | 0 | 30 | 0 | 0 | 30 | 0 | 10 | 30 | 0 | 20 | 30 | 0 | 30 | 30 |
| 160 | 0 | −30 | 30 | 0 | −20 | 30 | 0 | −10 | 30 | 0 | 0 | 30 | 0 | 0 | 30 | 0 | 0 | 30 | 0 | 10 | 30 | 0 | 20 | 30 | 0 | 30 | 30 |
| 192 | 10 | −30 | 30 | 10 | −20 | 30 | 10 | −10 | 30 | 10 | 0 | 30 | 10 | 0 | 30 | 10 | 0 | 30 | 10 | 10 | 30 | 10 | 20 | 30 | 10 | 30 | 30 |
| 224 | 20 | −30 | 30 | 20 | −20 | 30 | 20 | −10 | 30 | 20 | 0 | 30 | 20 | 0 | 30 | 20 | 0 | 30 | 20 | 10 | 30 | 20 | 20 | 30 | 20 | 30 | 30 |
| 255 | 30 | −30 | 30 | 30 | −20 | 30 | 30 | −10 | 30 | 30 | 0 | 30 | 30 | 0 | 30 | 30 | 0 | 30 | 30 | 10 | 30 | 30 | 20 | 30 | 30 | 30 | 30 |

FIG.9A

B, G, R, 301-64

| 64 | 0 | | | 32 | | | 64 | | | 96 | | | 128 | | | 160 | | | 192 | | | 224 | | | 255 | | |
|---|---|---|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | −10 | 10 | 0 | −15 | 20 | −5 | −20 | 30 | −10 |
| 32 | 0 | 0 | 0 | 0 | 0 | 0 | 0 | 0 | 0 | 0 | 0 | 0 | 0 | 0 | 0 | 0 | 0 | 0 | −5 | 10 | 0 | −10 | 20 | −5 | −15 | 30 | −10 |
| 64 | 0 | 0 | 0 | 0 | 0 | 0 | 0 | 0 | 0 | 0 | 0 | 0 | 0 | 0 | 0 | 0 | 0 | 0 | 0 | 10 | 0 | −5 | 20 | −5 | −10 | 30 | −10 |
| 96 | 0 | 0 | 0 | 0 | 0 | 0 | 0 | 0 | 0 | 0 | 0 | 0 | 0 | 0 | 0 | 0 | 0 | 0 | 0 | 10 | −10 | 0 | 20 | −15 | 0 | 30 | −20 |
| 128 | 0 | 0 | 0 | 0 | 0 | 0 | 0 | 0 | 0 | 0 | 0 | 0 | 0 | 0 | 0 | 0 | 0 | 0 | 0 | 10 | −15 | 0 | 20 | −20 | 0 | 30 | −25 |
| 160 | 0 | 0 | 0 | 0 | 0 | 0 | 0 | 0 | 0 | 0 | 0 | 0 | 0 | 0 | 0 | 0 | 0 | 0 | 0 | 10 | −20 | 0 | 20 | −25 | 0 | 30 | −30 |
| 192 | 10 | −10 | 0 | 10 | −5 | 0 | 10 | 0 | 0 | 10 | 0 | −10 | 10 | 0 | −15 | 10 | 0 | −20 | 10 | 10 | −25 | 10 | 20 | −30 | 10 | 30 | −35 |
| 224 | 20 | −15 | −5 | 20 | −10 | −5 | 20 | −5 | −5 | 20 | 0 | −15 | 20 | 0 | −20 | 20 | 0 | −25 | 20 | 10 | −30 | 20 | 20 | −35 | 20 | 30 | −40 |
| 255 | 30 | −20 | −10 | 30 | −15 | −10 | 30 | −10 | −10 | 30 | 0 | −20 | 30 | 0 | −25 | 30 | 0 | −30 | 30 | 10 | −35 | 30 | 20 | −40 | 30 | 30 | −45 |

DISPLAY DEVICE AND DISPLAY METHOD

CROSS-REFERENCE TO RELATED APPLICATION

The present application claims priority from Japanese Application JP2020-202426, the content of which is hereby incorporated by reference into this application.

BACKGROUND OF THE INVENTION

1. Field of the Invention

The present invention relates to a display device and a display method.

2. Description of the Related Art

For display devices presenting four primary colors, a technique known in the art optimizes a combination of values of the four primary colors, without compromising such display performance as power consumption of a light-emitting display device and visibility of a non-light-emitting display device at a wide viewing angle. (See, for example, WO/2013-128687.)

SUMMARY OF THE INVENTION

In an organic EL panel including, for example, pixels of four RGBW colors (red, green, blue, and white), a white (W) pixel glows in displaying an image to make up for insufficient luminance caused by a characteristic of the organic EL panel. Here, the image to be displayed could appear whitish.

An aspect of the present invention reduces the risk of an image to appear whitish.

A display device according to an aspect of the present invention includes: a first processor increasing or decreasing values of color components representing three colors and included in a first video signal, in accordance with values corresponding to the values of the color components representing three colors; a second processor converting a second video signal into a third video signal, the second video signal including the color components representing three colors and having the values increased or decreased by the first processor, and the third video signal including color components representing four colors; and a display displaying the third video signal including the color components representing four colors.

A display method according to an aspect of the present invention includes: increasing or decreasing values of color components representing three colors and included in a first video signal, in accordance with values corresponding to the values of the color components representing three colors; converting a second video signal into a third video signal, the second video signal including the color components representing three colors and having the values increased or decreased, and the third video signal including color components representing four colors; and displaying the third video signal including the color components representing four colors.

BRIEF DESCRIPTION OF THE DRAWINGS

FIG. 3A is an exemplary look-up table (LUT);

FIG. 9A is an exemplary LUT for BT.2020; and

DETAILED DESCRIPTION OF THE INVENTION

Embodiments are described below, with reference to the drawings. Note that like reference signs designate identical or corresponding components throughout the drawings. Such components will not be repeatedly elaborated upon.

A display device according to an embodiment will be described, with reference to FIGS. 1 and 2.

Figure 1:
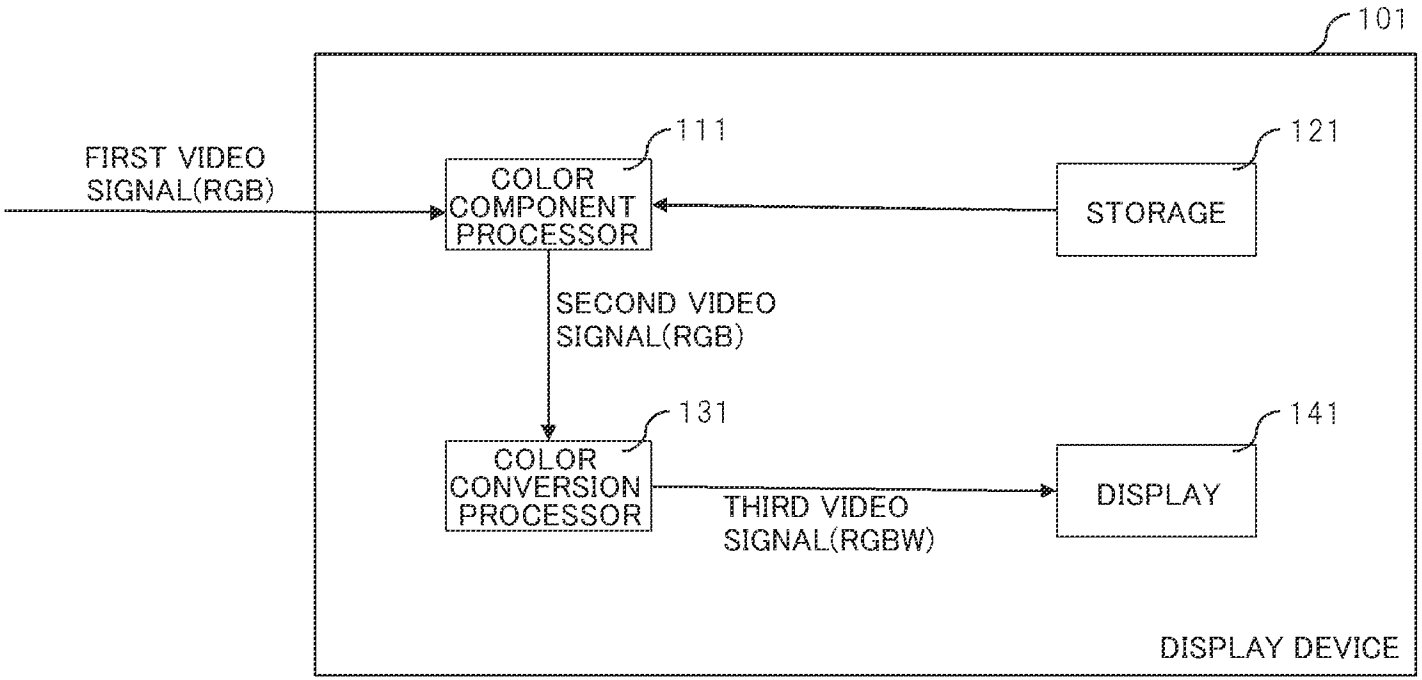
FIG. 1 is a diagram illustrating an exemplary configuration of a display device according to an embodiment.

FIG. 1 is a diagram illustrating an exemplary configuration of a display device according to an embodiment. FIG. 2 is a diagram illustrating an example of processing performed by the display device according to the embodiment.

A display device 101 includes: a color component processor (a first processor) 111; a storage 121; a color conversion processor (a second processor) 131; and a display 141. An example of the display device 101 is a liquid-crystal display device, an organic electro-luminescence (EL) display device, a television receiver, or a personal computer (PC).

The color component processor 111 receives a first video signal including color components representing three colors. The first video signal is, for example, a video signal for digital terrestrial television broadcasting. In the embodiment, the color components representing three colors are of, for example, red (R), green (G), and blue (B). Moreover, in this embodiment, a value (a signal level) of each of the color components ranges from 0 to 255. For example, as illustrated in FIG. 2, the color component processor 111 receives a first video signal 201 including color components representing three colors. The values (R, G, B) of the color components representing red (R), green (G), and blue (B) are (R, G, B)=(124, 128, 64).

The color component processor 111 increases or decreases the values of the color components representing three colors and included in the first video signal, using values corresponding to the values of the color components representing three colors. The color component processor 111 increases or decreases the values of the color components representing three colors, using, for example, values (increase-decrease values) corresponding to the values of the color components representing three colors. The increase-decrease values are listed in a lookup table (LUT) stored in the storage 121 to be described later. The color component processor 111 may increase or decrease the values of the color components representing either all of the three colors, or one or two of the three colors. The color component processor 111 outputs, to the color conversion processor 131, a second video signal including the increased or decreased values of the color components representing three colors. Details of the processing performed by the color component processor 111 will be described later.

An example of the color component processor 111 is a processor such as a central processing unit (CPU), or a logic circuit (hardware) implemented on such a component as an integrated circuit (an IC) chip.

The storage 121 stores, for example, a program or data to be used for the display device 101. An example of the storage 121 is a storage device such as a hard disk drive (an HDD), a random access memory (a RAM), or a flash memory. The storage 121 stores a lookup table (LUT) listing increase-decrease values corresponding to the values of the color components representing the three colors. The LUT is, for example, previously stored in the storage 121.

Figure 3B:
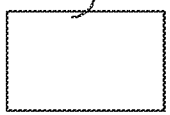
FIG. 3B is an exemplary LUT.
Figure 3B:
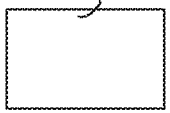
Figure 3B:
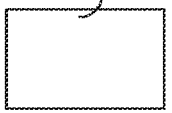
Figure 3B:
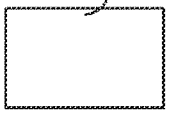
Figure 3B:
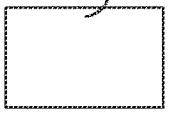

FIGS. 3A and 3B show exemplary LUTs.

The storage 121 stores, for example, LUTs 301-*i* (where i=0, 32, 64, 96, 128, 160, 192, 224, and 225) as illustrated in FIGS. 3A and 3B. Each of the LUTs 301-0, 301-32, 301-64, 301-96, 301-128, 301-160, 301-192, 301-224, and 301-225 has a value of blue (B) corresponding to 0, 32, 64, 96, 128, 160, 192, 224, and 225. Note that FIG. 3B omits the values of the LUTs 301-96, 301-128, 301-160, 301-192, and 301-224.

Figure 2:
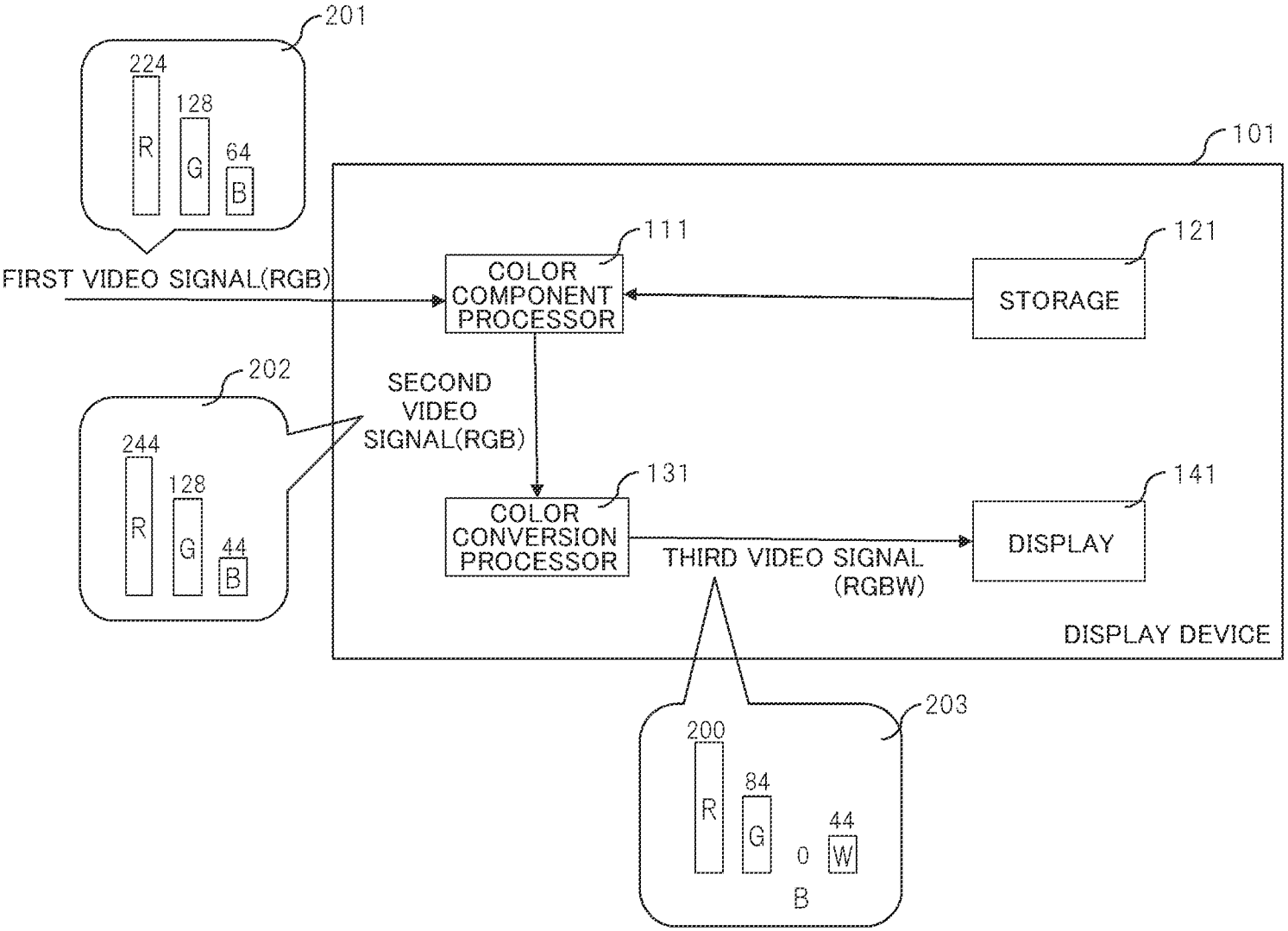
FIG. 2 is a diagram illustrating an example of processing performed by the display device according to the embodiment.

As illustrated in FIG. 2, the color component processor 111 receives the first video signal 201 whose color component of blue (B) has a value of 64. With reference to the LUT 301-64, the color component processor 111 increases or decreases the color components of the three colors, using values (increase-decrease values) corresponding to the values of the color components representing the three colors and listed in the LUT 301-64.

Details of the LUTs will be described here, with reference to the LUT 301-64.

Figure 4:
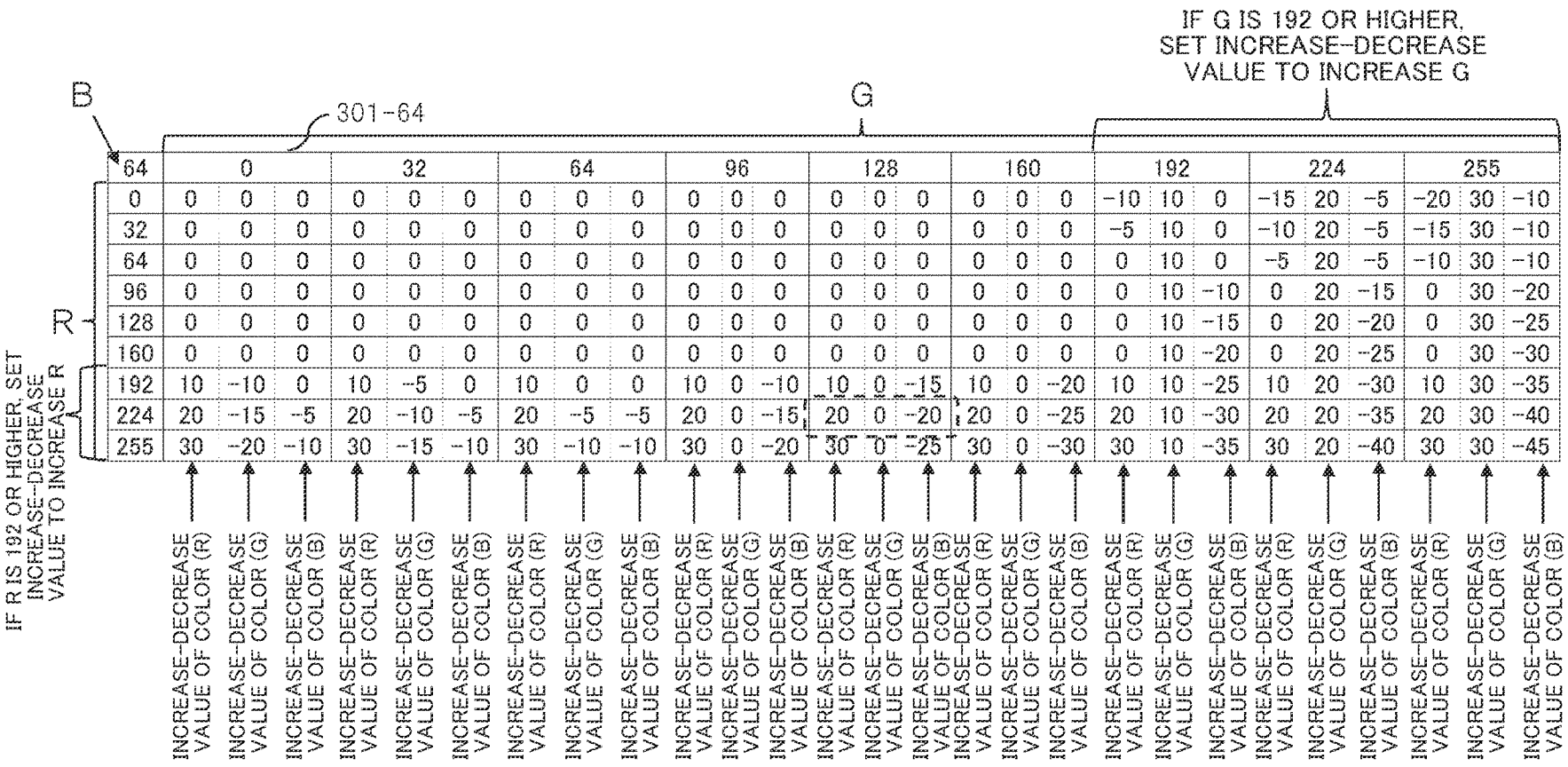
FIG. 4 is an exemplary LUT.

FIG. 4 illustrates the LUT 301-64.

The LUT 301-64 corresponds to a value of blue (B)=64 among the three colors represented by the color components.

In the upper left (the first row from the top and the first column from the left) of the LUT301-64, a value of blue (B)=64 is listed.

In the LUT 301-64, of the first row from the top and the second to tenth columns from the left, listed are values of green (G) among the three colors represented by the color components. Each of the listed values is 0, 32, 64, 96, 128, 160, 192, 224, and 225.

In the LUT 301-64, of the first column from the left and the second to tenth rows from the top, listed are values of red (R) among the three colors represented by the color components. Each of the listed values is 0, 32, 64, 96, 128, 160, 192, 224, and 225.

In the LUT 301-64, each cell corresponding to a value of G and a value of R shows three values (increase-decrease values). The three values are increase-decrease values of the respective color components of R, G, and B.

For example, in the LUT 301-64 of FIG. 4, a cell enclosed in a dotted frame and corresponding to R=224 and G=128 shows 20, 0, and −20. When the values of the color components representing the three colors (R, G, B) and included in the first video signal are (R, G, B)=(224, 128, 64), the values 20, 0, and −20 respectively represent increase-decrease values of the color components R, G, and B. That is, when the values of the color components representing the three colors (R, G, B) and included in the first video signal are (R, G, B)=(224, 128, 64), the dotted frame shows that the value of the color component R is increased by 20, the value of the color component G is increased by 0 (that is, the color component G is not increased), and the value of the color component B is decreased by 20.

Desirably, the increase-decrease values of the color components R, G, and B listed in the LUTs 301-*i* are set, taking the following points into consideration.

Among the color components representing three colors and included in the first video signal input into the color component processor 111, a color component having the lowest signal level is decreased in signal level. For example, when the values of the color components representing three colors (R, G, B) are (R, G, B)=(224, 128, 64), the value of color (B) is the smallest. Hence, an increase-decrease value is set to decrease the value of color (B). Note that, among the color components representing three colors and included in the first video signal, a color component having the lowest signal level does not have to be decreased in signal level. Furthermore, among the color components representing three colors, if two or more of the color components have the lowest signal level (e.g. (R, G, B)=(192, 64, 64)), any given lowest signal level may be decreased.

Among the color components representing three colors and included in the first video signal input into the color component processor 111, a color component having the highest signal level is increased in signal level. For example, when the values of the color components representing the three colors (R, G, B) are (R, G, B)=(224, 128, 64), the value of color (R) is the largest. Hence, an increase-decrease value is set to increase the value of color (R). Note that, among the color components representing the three colors and included in the first video signal, a color component having the highest signal level does not have to be increased in signal level.

Moreover, if a signal level of a color component is a predetermined value (e.g., 192) or higher, the increase-decrease value may be set to increase the signal level of the color component. Note that, if a signal level of a color component is a predetermined value (e.g., 192) or higher, the increase-decrease value may be set not to decrease the signal level even if the signal level is the lowest of all the signal levels of the color components representing the three colors, but rather to increase the signal level of the color component. In the LUT 301-64 in FIG. 4, for example, the cells denoted with a value of color (R) of 192 or larger show a positive value as an increase-decrease value of color (R) to increase the value of color (R). The cells denoted with a value of color (G) of 192 or larger show a positive value as an increase-decrease value of color (G) to increase the value of color (G). Such features make it possible to display an image more clearly.

Furthermore, the LUT 301-*i* according to this embodiment lists increase-decrease values corresponding to signal levels from 0 to 255 with increments of 32 (0, 32, 64, 96, 128, 160, 192, 224, and 225). The number of the LUTs may be increased or decreased, depending on performance of the color component processor 111 and storage capacity of the storage 121. That is, an LUT may list increase-decrease values corresponding to signal levels with increments of either 1 or 64.

Described here is exemplary processing performed by the color component processor 111.

For example, as illustrated in FIG. 2, the color component processor 111 receives the first video signal in which values of color components representing R, G, and B (red, green, and blue) are (R, G, B)=(224, 128, 64).

Because the value of the color component B is 64, the color component processor 111 refers to the LUT 301-64, and then refers to a cell corresponding to G=128 and R=224 in the LUT 301-64. As illustrated in FIG. 4, the cell enclosed in a dotted frame and corresponding to G=128 and R=224 shows the values (the increase-decrease values) of 20, 0, and −20. Hence, for the first video signal, the color component processor 111 increases the value of color (R) 224 by 20 and the value of color (G) 128 by 0, and decreases the value of color (G) 64 by 20. Thus, the color component processor 111 calculates values of color components representing three colors (R, G, B)=(244, 128, 44), and outputs, to the color conversion processor 131, the second video signal including the calculated values of the color components representing three colors.

Note that a value of a color component ranges from 0 to 255. Hence, the color component processor 111 performs processing to clip the value of the color component to 0 if the value falls below 0, and to 255 if the value exceeds 255. That is, the value of the color component is set to 0 if the value falls below 0, and is set to 255 if the value exceeds 255.

Figure 5:
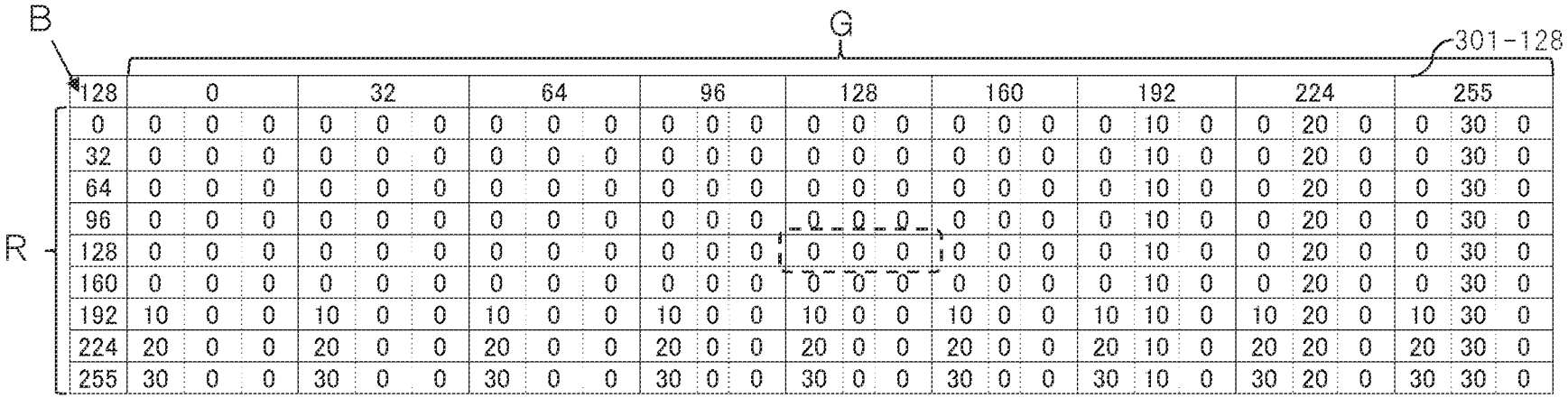
FIG. 5 is an exemplary LUT.

Furthermore, for example, if the signal levels of the color components representing three colors are substantially of the same value, such that the values of the color components representing R, G, and B (red, green, and blue) and included in the first video signal are (R, G, B)=(128, 128, 128), and if the first video signal is a value of white or of whitish color, the increase-decrease values corresponding to the color components are set to 0, as the values (0, 0, 0) shown in the cell that is enclosed in a dotted frame in the LUT 301-128 of B=128 in FIG. 5 and that corresponds to R=128 and G=128, in order not to change white balance or not to affect (or in order to reduce an effect to) colors such as skin tone to which people are sensitive. Such a feature makes it possible to process a specific color without increasing or decreasing the values of the color.

Moreover, if, for example, the values of the color components representing R, G, and B (red, green, and blue) and included in the first video signal are (R, G, B)=(176, 128, 64), the value of color (B) is 64. Here, the color component processor 111 refers to the LUT 301-64 in FIG. 4; however, the LUT 301-64 has no cell for R=176. In such a case, as to the color (R), a cell to be referred to may be the one corresponding to 192, which is closest to 176, among the signal levels of the color (R) listed in the LUT 301-64. That is, if the values of the color components representing R, G, and B are (R, G, B)=(176, 128, 64), the color component processor 111 may refer to a cell, in the LUT 301-64, corresponding to G=128 and R=192, and use values (increase-decrease values) 10, 0, and −15 shown in the cell to increase and decrease the values of the color components. Furthermore, the color component processor 111 may refer to cells, for the signal levels of the color (R) listed in the LUT 301-64, corresponding to signal levels 192 and 160 before and after the signal level 176. Then, the color component processor 111 may calculate the increase-decrease values of the color components based on linearity. Specifically, for example, the LUT 301-64 shows that an increase-decrease value is 0, for the color (R), in a cell corresponding to G=128 and R=160, and that an increase-decrease value is 10, for the color (R), in a cell corresponding to G=128 and R=192. Hence, if the color (R) is 176, the increase-decrease value of the color (R) is calculated as (0+10)*(176−160)/(192−160)=5. The values of the colors (G) and (B) are also obtained in a similar manner.

The description will now proceed, returning back to FIG. 1.

The color conversion processor 131 receives from the color component processor 111 the second video signal including the color components representing three colors. The color conversion processor 131 then converts the color components, representing three colors and included in the second video signal, into color components representing four colors. After that, the color conversion processor 131 outputs, to the display 141, a third video signal including the converted color components representing four colors.

In the embodiment, the color components representing four colors are of red (R), green (G), blue (B), and white (W). Moreover, in this embodiment, a value (a signal level) of each of the color components ranges from 0 to 255.

The color conversion processor 131, for example, subtracts the smallest value from the values of the color components representing three colors and included in the second video signal. The color conversion processor 131 sets a value of a color component representing white (W) as the smallest value among the values of the color components representing three colors, and outputs, to the display 141, a third video signal 203 including the color components representing four colors.

Specifically, as illustrated in FIG. 2, for example, the values of the color components representing R, G, and B and included in the second video signal 202 are (R, G, B)=(244, 128, 44). Here, the value 44 of blue (B) is the smallest value among the values of the color components representing the three colors. The color conversion processor 131 subtracts the smallest value (=44) from each of the values (R, G, B)=(244, 128, 44) of the color components representing R, G, and B and included in the second video signal 202, and obtains the values (R, G, B)=(200, 84, 0) of the color components representing R, G, and B, and included in the third video signal 203. The color conversion processor 131 determines that a value of a color component representing white (W) and included in the third video signal 203 is the smallest value 44 among the values of the color components representing three colors and included in the second video signal 202. The color conversion processor 131 outputs, to the display 141, the third video signal 203 including the obtained values (R, G, B, W)=(200, 84, 0, 4) representing four colors R, G, B, and W of the color components.

An example of the color conversion processor 131 is a processor such as a central processing unit (CPU), or a logic circuit (hardware) implemented on such a component as an integrated circuit (an IC) chip.

Note that the color conversion processor 131 according to the embodiment converts the color components representing three colors into the color components representing four colors. However, such a conversion technique is an example, and shall not be limited to the above one.

The display 141 displays the third video signal to be output from the color conversion processor 131 and including the color components representing four colors. The display 141 includes a plurality of pixels, and each of the pixels includes sub-pixels glowing respective four colors of, for example, red, green, blue, and white. That is, four sub-pixels constitute one pixel.

An example of the display 141 includes a liquid crystal panel or an organic EL panel.

Here, the embodiment is compared with a comparative example in order to facilitate understanding of the advantageous effects of the embodiment.

Figure 6:
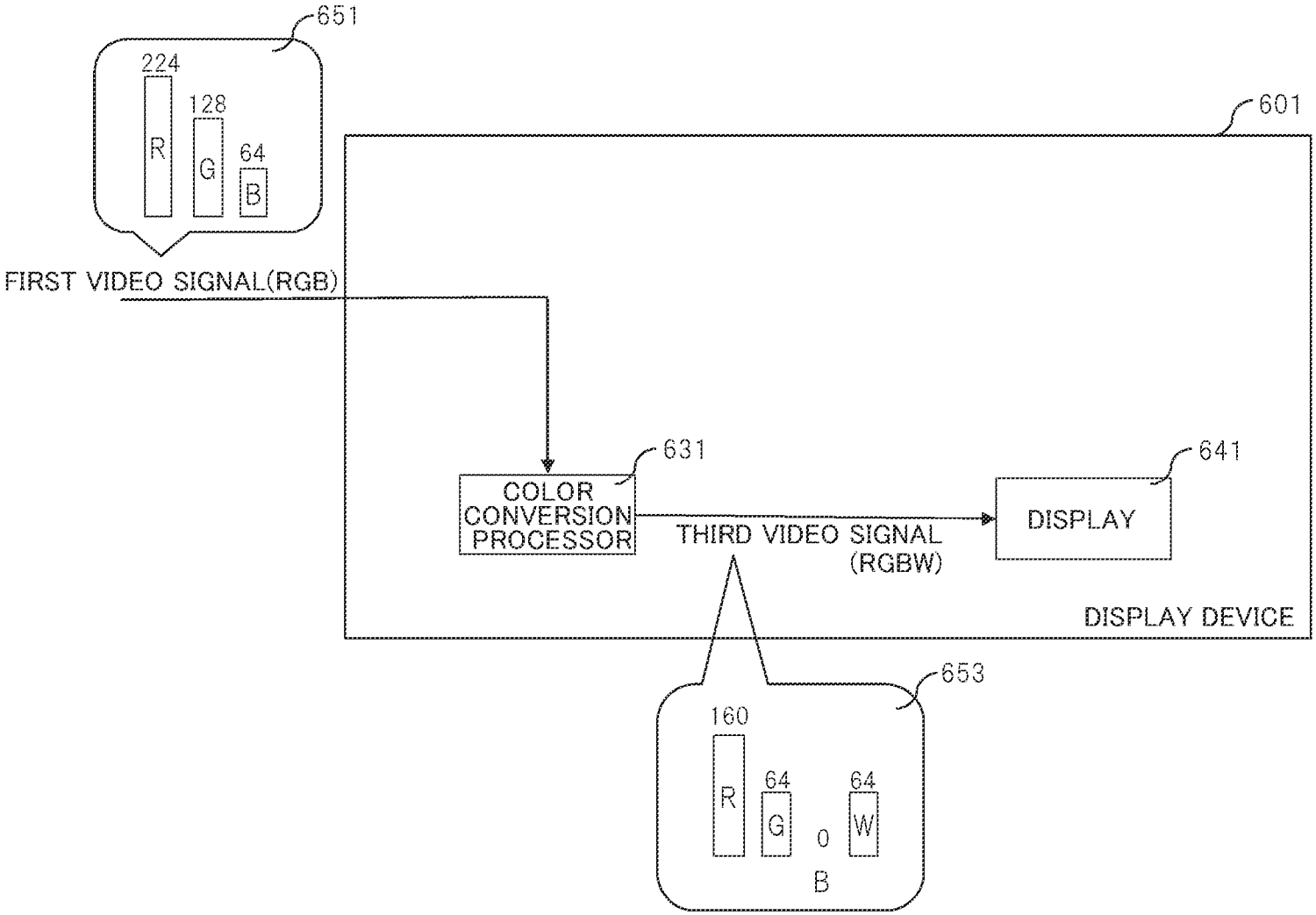
FIG. 6 is a diagram illustrating an example of processing performed by a display device according to a comparative example.

FIG. 6 is a diagram illustrating an example of processing performed by a display device according to a comparative example.

A display device 601 according to a comparative example includes: a color conversion processor 631; and a display 641.

The color conversion processor 631 and the display 641 respectively have the same functions as the color conversion processor 131 and the display 141 according to the embodiment have. The display device 601 according to the comparative example includes no constituent feature corresponding to the color component processor 111 according to the embodiment, and the color components are not increased or decreased (adjusted) before the color conversion processor converts a video signal including color components representing three colors into another video signal including color components representing four colors.

When the display device 601 receives a first video signal 651 in which values of color components representing R, G, and B, are (R, G, B)=(224, 128, 64), as seen in the embodiment in FIG. 2, the color conversion processor 631 receives the first video signal 651.

The color conversion processor 631 then converts the color components, representing three colors and included in the first video signal 651, into color components representing four colors. After that, the color conversion processor 631 outputs, to the display 641, a third video signal 653 including the converted color components representing four colors.

As illustrated in FIG. 6, for example, the values of the color components representing R, G, and B and included in the first video signal 651 are (R, G, B)=(244, 128, 64). Here, the value 64 of blue (B) is the smallest value among the values of the color components representing three colors. The color conversion processor 631 subtracts the smallest value (=64) from each of the values (R, G, B)=(244, 128, 64) of the color components representing R, G, and B and included in the first video signal, and obtains the values (R, G, B)=(160, 64, 0) of the color components representing R, G, and B, and included in the third video signal 653. The color conversion processor 631 determines that a value of a color component representing white (W) and included in the third video signal 653 is the smallest value 64 among the values of the color components representing the three colors and included in the first video signal. The color conversion processor 631 outputs, to the display 641, the third video signal 653 including the obtained values (R, G, B, W)=(160, 64, 0, 64) representing four colors R, G, B, and W of the color components.

Here, a comparison between the third video signal 203 in FIG. 2 according to the embodiment and the third video signal 653 according to the comparative example shows that the value 44 of white (W) in the third video signal 203 according to the embodiment is smaller than the value 64 of white (W) in the third video signal 653 according to the comparative example. Moreover, the values 200 and 84 of red (R) and green (G) included in the third video signal 203 according to the embodiment are larger than the values 160 and 64 of red (R) and green (G) included in the third video signal 653 according to the comparative example. As can be seen, the display device 101 according to the embodiment reduces the smallest value whose color component has the lowest signal level among the color components representing the three colors. Such a feature makes it possible to increase proportions of color components representing the rest of the two colors, and to curb a phenomenon in which an image to be displayed appears whitish. Moreover, the feature emphasizes (increases) a value of a color component having a high signal level and reduces the value of color (W), making it possible to curb the phenomenon in which an image to be displayed appears whitish.

In relation to a case where two of the three color components have a high signal level, the display device 101 according to the embodiment can emphasize not only the colors of R, G, and B but also colors of cyan, yellow, and magenta. Such a feature makes it possible to display an image more clearly.

For example, if the values of the color components representing R, G, and B and included in the first video signal to be input into the display device 101 are (R, G, B)=(224, 224, 64), and represent a yellowish color, the color component processor 111 refers to the LUT 301-64 illustrated in FIG. 4 and obtains increase-decrease values of R, G, and B. The obtained increase-decrease values of R, G, and B are respectively 20, 20, and −35. Using the increase-decrease values of the R, G, and B, the color component processor 111 increases or decreases the values of the color components representing R, G, and B, such that the values of the color components representing R, G, and B and included in the second video signal are (R, G, B)=(244, 244, 29). The color conversion processor 131 converts the color components, representing three colors and included in the second video signal, into a color components representing four colors of R, G, B, and W and included in the third video signal. Hence, the values of the color components for R, G, B, and W are (R, G, B, W)=(215, 215, 0, 29).

Likewise, in the display device 601 according to the comparative example, the first video signal includes color components whose values of R, G, and B are (R, G, B)=(224, 224, 64). When the first video signal is input, the color conversion processor 631 outputs the third video signal including color components whose values of four colors R, G, B, W are (R, G, B, W)=(180, 180, 0, and 64).

When a comparison is made between: the color components (R, G, B, W)=(215, 215, 0, 29) representing four colors and included in the third video signal according to the embodiment; and the color components (R, G, B, W)=(180, 180, 0, 64) representing four colors and included in the third video signal according to the comparative example, the signal levels of R and G among the color components representing four colors according to the embodiment are respectively larger by 35 than the signal levels of R and G according to the comparative example, and the signal level of W according to the embodiment is smaller by 35 than the signal level of W according to the comparative example. Hence, the display device 101 according to the embodiment displays an intensely colored image, reducing the risk that the image appears whitish.

Modification

Without using an LUT, the color component processor 111 may calculate a value (an amount of gain) corresponding to values of color components representing three colors, using a previously set expression. Using the calculated amount of gain, the color component processor 111 may increase or decrease the values of the color components representing three colors.

Figure 7A:
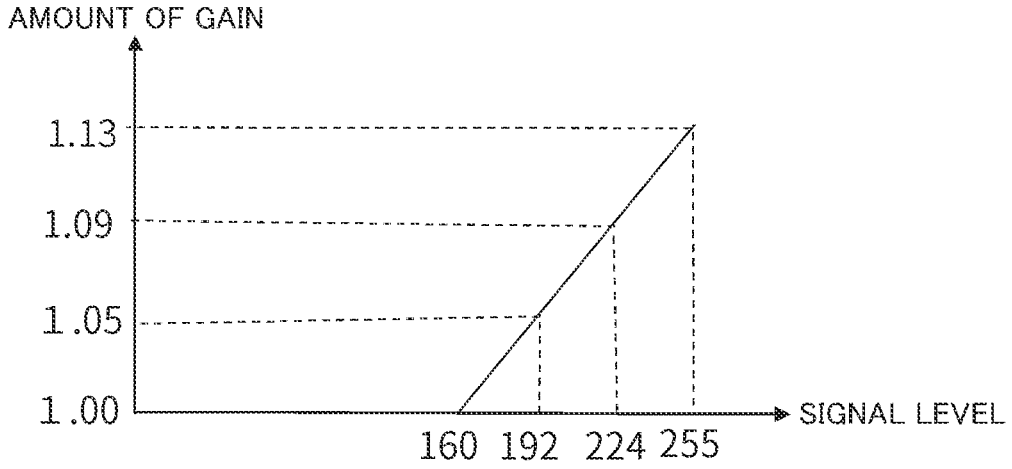
FIG. 7A is a graph illustrating an amount of gain when a signal level is 160 or higher.
Figure 7B:
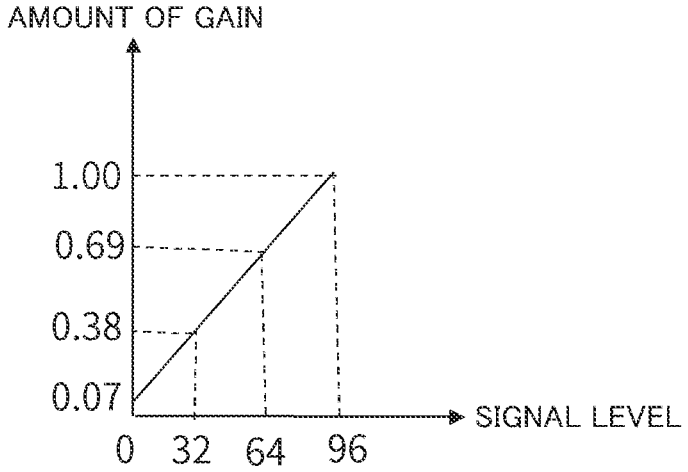
FIG. 7B is a graph illustrating an amount of gain when a signal level is 96 or lower.

FIG. 7A is a graph illustrating an amount of gain when a signal level is 160 or higher. FIG. 7B is a graph illustrating an amount of gain when a signal level is 96 or lower. In FIGS. 7A and 7B, the vertical axes represent amounts of gain, and the horizontal axes represent signal levels. An expression of the graph in FIG. 7A is $Y=0.0014X+0.7767$ where Y is an amount of gain and X (160 or higher and 225 or lower) is a signal level. Moreover, an expression of the graph in FIG. 7B is $Y=0.0097X+0.07$ where Y is an amount of gain and X (0 or higher and 96 or lower) is a signal level.

If the signal level is 160 or higher, the color component processor 111 calculates an amount of gain for each of the values (signal levels) of the color components representing three colors and included in the first video signal, using the previously set expression of the graph illustrated in FIG. 7A. Using the calculated amount of gain, the color component processor 111 increases a value of a color component having a signal level of 160 or higher.

Furthermore, if the signal level is 96 or lower, the color component processor 111 calculates an amount of gain for each of the values (signal levels) of the color components representing three colors and included in the first video signal, using the previously set expression of the graph illustrated in FIG. 7B. Using the calculated amount of gain, the color component processor 111 decreases a value of a color component having a signal level of 96 or lower.

For example, if the values of the color components representing three colors (R, G, and B) and included in the first video signal are (R, G, B)=(224, 128, 64), the value of R is 160 or higher. Using the expression of the graph in FIG. 7A, the color component processor 111 calculates an amount of gain (=0.0014×224+0.7767) corresponding to a signal level of 224. Hence, 1.09 is obtained as the amount of gain corresponding to the signal level of 224 illustrated in FIG. 7A. The color component processor 111 multiplies the value of R in the first video signal by the calculated amount of gain, and calculates a value of R (=224×1.09=224) in the second video signal.

Moreover, a value of B in the first video signal is 96. Using the expression of the graph in FIG. 7B, the color component processor 111 calculates an amount of gain (=0.0097×64+0.07) corresponding to a signal level of 64. Hence, 0.69 is obtained as the amount of gain corresponding to the signal level of 96 illustrated in FIG. 7B. The color component processor 111 multiplies the value of B in the first video signal by the calculated amount of gain, and calculates a value of B (=64×0.69=44) in the second video signal.

Note that the expressions of the graphs in FIGS. 7A and 7B are examples, and the expressions for calculating amounts of gain can be set depending on a desired color to be set.

Another Embodiment

Figure 8:
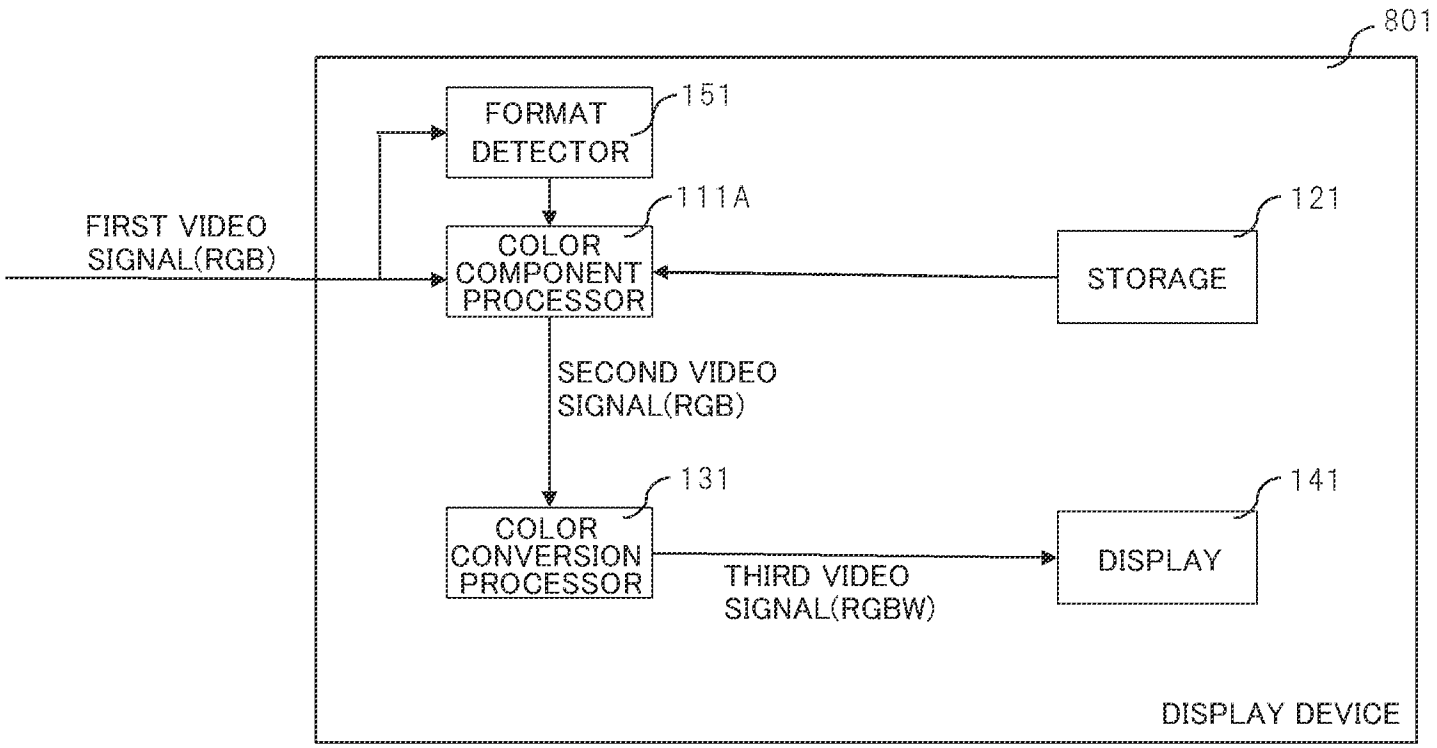
FIG. 8 is a diagram illustrating an exemplary configuration of a display device according to another embodiment.

FIG. 8 is a diagram illustrating an exemplary configuration of a display device according to another embodiment.

A display device 801 includes: a color component processor (a first processor) 111A; the storage 121; the color conversion processor (the second processor) 131; the display 141; and a format detector 151.

The functions and configurations of the storage 121, the color conversion processor 131, and the display 141 are described with reference to FIGS. 1 and 2, and will not be elaborated upon here.

Similar to the color conversion processor 131, the format detector 151 receives the first video signal including color components representing three colors. The format detector 151 detects a format of, for example, a color gamut and a dynamic range of the first video signal. The format detector 151 detects a format from Infoframe included in the first video signal; that is, a signal for the high-definition multimedia interface (HDMI®). The format of the first video signal is, for example, the standard dynamic range (SDR), the high dynamic range with HLG (HLG HDR), the HDR with PQ (PQ HDR), the BT. 709, or the BT. 2020. The format detector 151 outputs, to the color component processor 111, a result of the detection indicating the detected format of the first video signal.

An example of the format detector 151 is a processor such as a central processing unit (CPU), or a logic circuit (hardware) implemented on such a component as an integrated circuit (an IC) chip.

The color component processor 111A increases or decreases values of the color components representing three colors and included in the first video signal, in accordance with the result of the detection and values corresponding to the values of the color components representing three colors. For example, if the format of the first video signal is the BT. 2020, the color component processor 111A increases or decreases the values of the color components representing three colors and included in the first video signal in accordance with values corresponding to the values of the color components listed in an LUT for the BT. 2020. If the format of the first video signal is the BT. 709, the color component processor 111A increases or decreases the values of the color components representing three colors and included in the first video signal in accordance with values corresponding to the values of the color components listed in an LUT for the BT. 709. Note that the storage 121 stores LUTs for the formats.

An example of the color conversion processor 111A is a processor such as a central processing unit (CPU), or a logic circuit (hardware) implemented on such a component as an integrated circuit (an IC) chip.

Figure 9B:
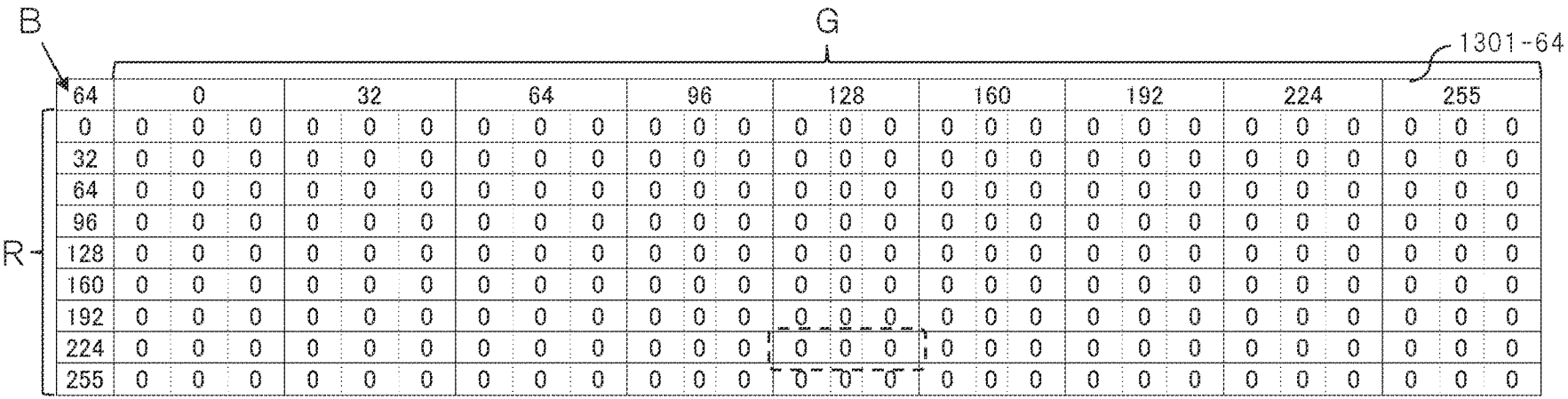
FIG. 9B is an exemplary LUT for BT.709.

FIG. 9A is an exemplary LUT for BT.2020. FIG. 9B is an exemplary LUT for BT.709.

For example, if the result of the detection (the format of the first video signal) is the BT. 2020 and the values of the color components representing three colors R, G, and B are (R,G,B)=(224, 128, 64), the color component processor 111A increases or decreases the values of the color components representing three colors in accordance with values: corresponding to the values of the color components representing three colors; and listed in the LUT 301-64 for the BT. 2020 illustrated in FIG. 9A.

As illustrated in FIG. 9A, in the LUT 301-64 for B=64, a cell enclosed in a dotted frame and corresponding to G=128 and R=224 shows values (increase-decrease values) of 20, 0, and −20. The color component processor 111A increases the values of R=224 and G=128 in the first video signal respectively by 20 and 0, and decreases the value of B=64 by 20. Thus, the color component processor 111A calculates values of color components representing three colors (R, G, B)=(244, 128, 44), and outputs, to the color conversion processor 131, the second video signal including the calculated values of the color components representing three colors. After that, as can be seen in FIG. 2, the second video signal is converted by the color conversion processor 131 into the third video signal including values of color components representing four colors (R, G, B, W)=(200, 84, 0, 44). The third video signal is displayed on the display 141.

Moreover, for example, if the result of the detection (the format of the first video signal) is the BT. 709 and the values of the color components representing three colors (R,G,B) are (R,G,B)=(224, 128, 64), the color component processor 111A increases or decreases the values of the color components representing three colors in accordance with values: corresponding to the values of the color components representing three colors; and listed in the LUT 1301-64 for the BT. 709 illustrated in FIG. 9B.

As illustrated in FIG. 9B, in the LUT 1301-64 for B=64, a cell enclosed in a dotted frame and corresponding to G=128 and R=224 shows values (increase-decrease values) of 0, 0, 0. Hence, the color component processor 111A does not increase or decrease the values of the color components in the first video signal. Thus, the color component processor 111A outputs the second video signal to the color conversion processor 131. Similar to the first video signal, the second video signal includes the values of the color components representing three colors. After that, the second video signal is converted by the color conversion processor 131 into the third video signal including values of color components representing four colors (R, G, B, W)=(160, 64, 0, 64). The third video signal is displayed on the display 141.

As can be seen, if the format of the first video signal is the BT. 2020, an LUT for the BT. 2020 is used to increase or decrease values of color components by the color component processor 111A to keep colors from appearing whitish. If the format of the first video signal is the BT. 709, an LUT for the BT. 709 is used to reduce an increase or a decrease of values of color components by the color component processor 111A, such that colors to be reproduced are accurate with respect to an input signal (the first video signal).

The display device according to this embodiment switches LUTs to be used in accordance with a format of the first video signal, making it possible to set most appropriate colors depending on the format.

Software Implementation

The control blocks of the display devices 101 and 801 (particularly, the color component processors 111 and 111A, the color conversion processor 131, and the format detector 151) may be implemented by logic circuits (hardware) fabricated, for example, in the form of an integrated circuit (IC chip), and may be implemented by software run by a processor such as a central processing unit (CPU). In the latter form of implementation, the display devices 101 and 801, which are a computer, includes, among others: a CPU that executes instructions from programs or software by which various functions are implemented; a ROM (read-only memory) or like storage device (referred to as a "storage medium") containing the programs and various data in a computer-readable (or CPU-readable) format; and a RAM (random access memory) into which the programs are loaded. The computer (or CPU) then operates as the color component processors 111 and 111A, the color conversion processor 131, and the format detector 151, and retrieves and runs the programs contained in the storage medium, thereby achieving the object of an aspect of the present invention. The storage medium may be a "non-transitory, tangible medium" such as a tape, a disc/disk, a card, a semiconductor memory, or programmable logic circuitry. The programs may be supplied to the computer via any given transmission medium that can transmit the programs.

Note that the present invention shall not be limited to the above embodiments, and can be modified. The above configurations can be replaced with substantially the same configurations, configurations achieving the same advantageous effects as those of the present invention, or configurations achieving the same objects as those of the present invention.

What is claimed is:

1. A display device, comprising:

a first processor configured to increase or decrease values of color components representing three colors and included in a first video signal, in accordance with values corresponding to the values of the color components representing three colors, and to output a second video signal including the color components representing three colors and having the values increased or decreased;

a second processor configured to receive the second video signal including the color components representing three colors and having the values increased or decreased by the first processor, and to convert the second video signal into a third video signal including color components representing four colors; and a display configured to display the third video signal including the color components representing four colors.

2. The display device according to claim 1, wherein the first processor decreases a smallest value among the values of the color components representing three colors.

3. The display device according to claim 1, wherein the first processor increases a largest value among the values of the color components representing three colors, and the second video signal includes the increased largest value.

4. The display device according to claim 1, wherein the first processor increases or decreases the values of the color components representing three colors, in accordance with a lookup table listing the values corresponding to a combination of the values of the color components representing three colors.

5. The display device according to claim 1, further comprising:

a storage configured to store a plurality of lookup tables each corresponding to one of a plurality of formats; and a detector configured to detect a format of the first video signal, wherein each of the plurality of lookup tables lists a value corresponding to a combination of the values of the color components representing three colors, and the first processor refers to a first lookup table included in the plurality of lookup tables and corresponding to the detected format, and increases or decreases the values of the color components representing three colors, in accordance with values corresponding to the values of the color components representing three colors of the first lookup table.

6. The display device according to claim 1, wherein the color components representing three colors are red, green and blue, and the color components representing four colors are red, green, blue, and white.

7. A display method, comprising:

increasing or decreasing, by a first processor, values of color components representing three colors and included in a first video signal, in accordance with values corresponding to the values of the color components representing three colors;

outputting, by the first processor, a second video signal including the color components representing three colors and having the values increased or decreased;

receiving, by a second processor, the second video signal including the color components representing three colors and having the values increased or decreased by the first processor;

converting, by the second processor, the second video signal into a third video signal, the second video signal including the color components representing three colors and having the values increased or decreased, and the third video signal including color components representing four colors; and displaying the third video signal including the color components representing four colors.

* * * * *